US006499403B1

(12) United States Patent
Laulanet

(10) Patent No.: US 6,499,403 B1
(45) Date of Patent: Dec. 31, 2002

(54) METHOD OF DETECTING THE POSITIONAL ACCURACY OF REGISTER AND FOLDING OR CUTTING EDGES ON FLAT COPIES

(75) Inventor: Vincent Laulanet, Chantilly (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 207 days.

(21) Appl. No.: 09/686,108

(22) Filed: Oct. 11, 2000

(30) Foreign Application Priority Data

Oct. 11, 1999 (DE) ..... 199 48 924
May 30, 2000 (FR) ..... 00 06899

(51) Int. Cl.[7] ..... B41D 7/00

(52) U.S. Cl. ..... 101/486; 101/226; 101/248; 382/112; 382/294; 700/124; 700/125; 83/13

(58) Field of Search ..... 101/483, 485, 101/486, 493, 248, 226, 227, 181; 707/517, 520; 270/1.01, 20.1, 21.1, 1.03; 382/112, 284, 294; 700/122, 124, 125; 358/474, 1.1, 406; 83/13

(56) References Cited

U.S. PATENT DOCUMENTS 5,212,568 A * 5/1993 Graves ..... 358/474
5,452,636 A * 9/1995 Dürr et al. ..... 101/227
5,568,767 A 10/1996 Jackson ..... 101/486
5,664,076 A * 9/1997 Pinta et al. ..... 358/1.1
5,813,333 A * 9/1998 Ohno ..... 101/486
6,016,207 A * 1/2000 Wield ..... 358/406
6,058,201 A * 5/2000 Sikes ..... 382/112
6,018,687 A * 6/2000 Tabor ..... 700/125
6,075,905 A * 6/2000 Herman et al. ..... 382/294
6,226,419 B1 * 5/2001 Lodwick et al. ..... 382/294
6,332,149 B1 * 12/2001 Warmus et al. ..... 707/517

FOREIGN PATENT DOCUMENTS

DE 40 12 608 A1 10/1991
DE 44 37 603 A1 4/1996
WO WO 97/36749 10/1997

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A method of detecting the positional accuracy of register and any of folding and cutting-edge positions, respectively, on flat copies, including scanning a prescribable recording field on the copy by a detector, which comprises determining the position of the printed image and of the folding and cutting edges, respectively, by contrast transitions extending through screen fields.

10 Claims, 3 Drawing Sheets

METHOD OF DETECTING THE POSITIONAL ACCURACY OF REGISTER AND FOLDING OR CUTTING EDGES ON FLAT COPIES

BACKGROUND OF THE INVENTION

Field of the Invention

The invention relates to a method of detecting the positional accuracy of register and folding or cutting edges on flat copies in folders which are arranged downline from rotary printing machines for single-side or multi-side printing of material webs.

U.S. Pat. No. 5,568,767 is concerned with a method and a device for maintaining the register and the cut-off register in rotary printing machines. In a first method step, the position of each printed image on the material web is registered. This is followed by the generation of a reference signal which corresponds to a desired or nominal position of the image on a material web. A data stream corresponding to the register deviations is then generated, control commands to the control unit of the rotary printing machine being transmitted continuously and being based upon the data stream representing the register deviations. In addition, a control data stream which influences the speed of the rotating system is generated, the control data stream being determined by using the calculated changes in a data stream corresponding to the register deviations. Finally, the data streams which influence the machine torque are generated, these machine torque-influencing data streams being determined from the changes of a data stream which influences the speed of the rotating system.

By deviations determined in this manner, the phase angle of the cutting cylinder is influenced in order to produce the maintenance of register between the position of the printed image and the position of the cut edge.

The published International Patent Document WO 97/36749 is concerned with a method for the qualitative assessment of processed material. In this proposed method, by at least one photoelectric sensor and an evaluation device cooperating with the latter, image regions on the inspected material and assigned to possible fault sources are registered. In each case, the fault sources are represented by the printing plates of the printing-plate cylinder. Respective counting pulses are registered in separate counting units for copies which are found to be good and for printed copies which are found to be poor.

SUMMARY OF THE INVENTION

In view of the indicated prior art, it is accordingly an object of the invention to provide a method of the foregoing general type which is reliable and operates quickly for detecting the position of folding or cutting edges on flat copies and for detecting the position of the printed image.

With the foregoing and other objects in view, there is provided, in accordance with the invention, a method of detecting the positional accuracy of register and one of folding and cutting-edge positions, respectively, on flat copies, including scanning a prescribable recording field on the copy by a detector, which comprises determining the position of the printed image and of the folding and cutting edges, respectively, by contrast transitions extending through screen fields.

In accordance with another mode, the method invention includes prescribing scanning zones in the recording field by a user of the method.

In accordance with a further mode, the method invention includes superimposing screens on defined scanning zones in the recording field.

In accordance with an added mode, the method invention includes providing sets of vertical lines for covering at least one of the folding and the cutting edges, respectively, in the screen fields.

In accordance with an additional mode, the method invention comprises providing the screen fields with horizontal lines and vertical lines sweeping over edge regions.

In accordance with yet another mode, the method invention includes placing markings at the vertical lines interrupted at a transition between background and copy.

In accordance with yet a further mode, the method invention includes determining the course of the folding spine from the position of the markings.

In accordance with yet an added mode, the method invention includes determining the course of the cutting edges from the position of the markings.

In accordance with yet an additional mode, the method invention includes determining the position of the printed image from the markings of the screen field, which distinguish contrast leaps.

In accordance with a concomitant mode, the method invention includes determining the distance between the printed image and a respective folding and cutting edge from the course of the sequence of markings of the screen field, respectively, representing one of a folding spine and the cutting edges, respectively, and the markings of the screen field representing the edge of the printed image.

The objective of the invention is thus achieved by providing, in a method of detecting the positional accuracy of register and cutting or folding edges on flat copies, that a prescribed or predefined recording field on the copy be scanned by a detector, and that the position of the printed image and the position of folding or cutting edges be determined by using contrast transitions running through screen fields.

The advantages associated with the method proposed according to the invention reside in the fact that contrast leaps in screen fields are detectable in real time, and no evaluation routines which consume evaluation time have to be executed. With the selected procedure based upon the detection of contrast steps, the position of folding or cutting edges on flat products can be determined accurately, with an accuracy of ±0.1 mm, so that a self-diagnosis system which responds rapidly and extremely reliably in a folder arranged downline from a rotary printing machine can be made available.

In a further development of the concept upon which the invention is based, provision is made, within the recording field of a detector which can be constructed as a CCD camera, for example, to define various scanning zones and to configure them so that they can be defined by the user, the scanning zones, respectively, being of particular interest to the user. The scanning zones are, for example, the folding spine, a folded edge or even the edge region of a printed-image. These regions of interest to the user have screen fields, respectively, superimposed thereon. Depending upon the scanning zone of interest, respectively, the screen field can be formed differently. For example, those screen fields with which the position of the folding spine or the position of a cutting edge are detected contain a pattern of lines extending substantially perpendicularly to the respective folding or cutting edge. Screen fields with which the position of the printed image may be detected contain a pattern of lines which extend in the vertical and in the horizontal direction, respectively.

The screen fields or patches with the differently configured line patterns thereof are preferably placed in those zones wherein sharp contrast leaps occur, which can be evaluated. The contrast leaps located in the screen fields or patches are preferably interpreted as an interruption to the pattern of lines extending vertically or both vertically and horizontally and, if added up appropriately, reproduce the courses of folding or cutting edges or of the edge region of interest of printed images. By the rectilinear courses which result from the markings, the distance between the folding or cutting edge of the copy relative to the printed image may be determined, a distance which is critical for determining the correct register position of the printing plate on the printing-unit cylinders of the rotating system connected upline from the folder.

The user of the method proposed by the invention is able to define, by preselecting scanning zones which are of specific interest to him, individual regions which are of interest to him and which can vary to an extreme extent from printing subject to printing subject, as well as from print job to print job.

Other features which are considered as characteristic for the invention are set forth in the appended claims.

Although the invention is illustrated and described herein as embodied in a method of detecting the positional accuracy of register and folding or cutting edges on flat copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
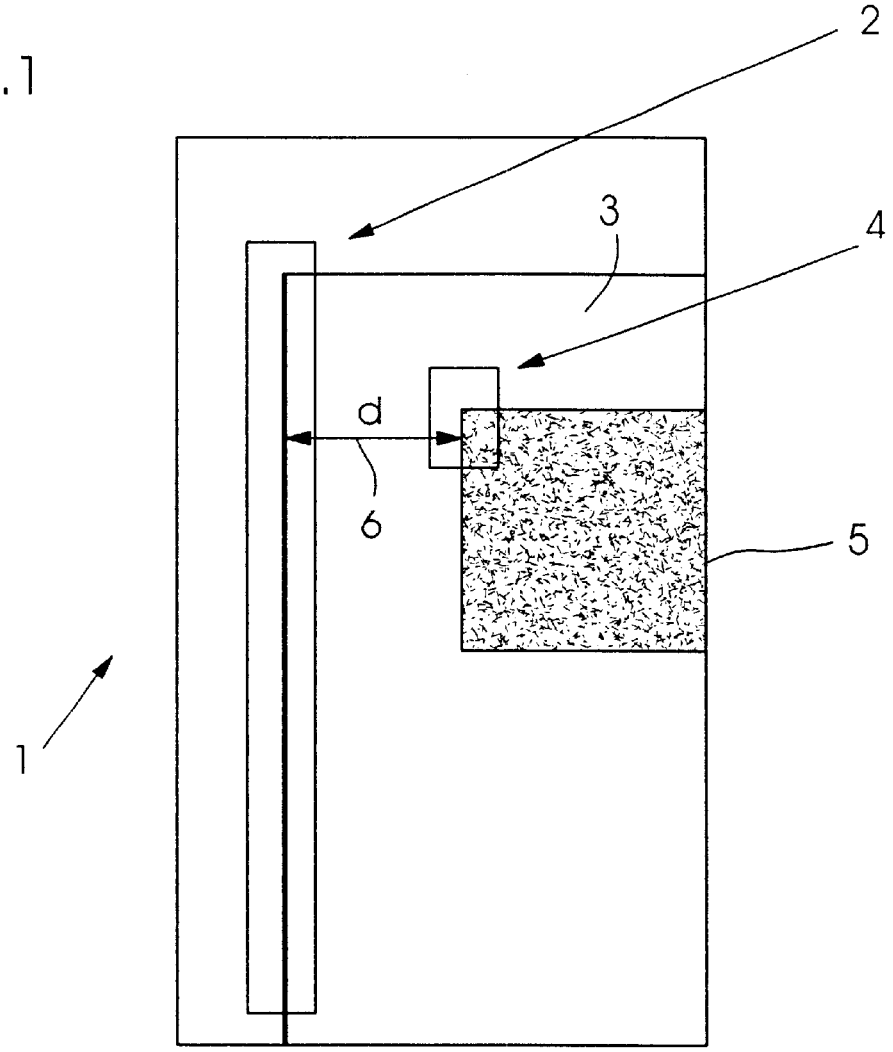
FIG. 1 is a diagrammatic view of a recording field of a detector, such as a CCD camera.

Referring now to the drawings and, first, particularly to FIG. 1 thereof, there is shown therein diagrammatically a recording field 1 of a detector, such as a CCD camera.

In the illustrated example, the recording field 1 has an approximately rectangular appearance and includes both a folding-edge or cutting-edge zone 2 at an edge region 4 of a printed image 5. An area 3 of the copy exhibiting the details shown in FIG. 1 represents a corner of a flat copy, a distance d identified by reference numeral 6, which extends from the folding or cutting edge to the edge region of the printed image 5, being of great interest to the user. From the distance 6, conclusions may be drawn regarding the maintenance of the register of the printing form or plate on the printing-unit cylinders of an upline rotary printing machine and, in addition, this distance 6 can be used for finishing processes, during the subsequent further processing of the copies transported out of the folder, for determining the intervals between side-edge trim cuts or finishing trim cuts on the completely folded flat copies.

Figure 2:
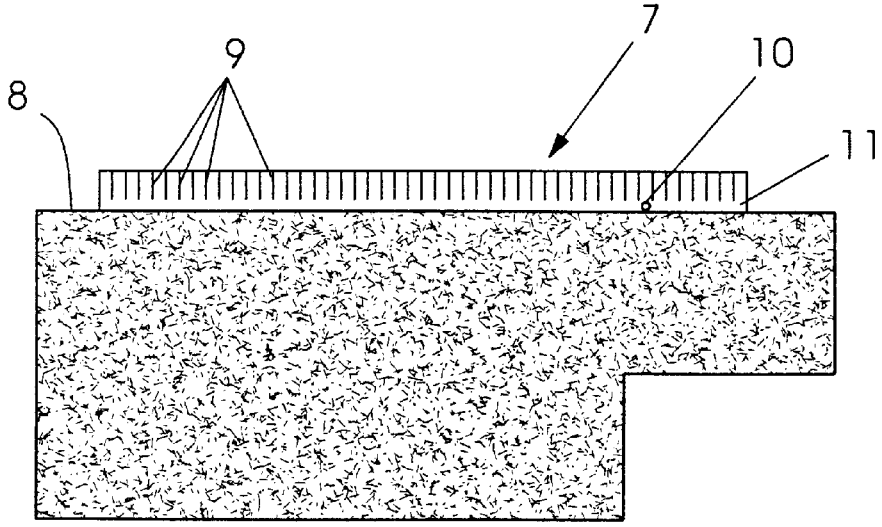
FIG. 2 is a diagrammatic view of a screen field or patch superimposed on a folding edge and having substantially vertically stamped series of lines.

FIG. 2 illustrates a screen field or patch superimposed on a folding edge, in this case, a folding spine, and having substantially vertically extending series of lines.

Superimposed on the region of the folding spine 8 of a finished folded copy 13 is a vertical grid 7 that extends along the folding-edge or cutting-edge zone 2. The vertical grid 7 has a multiplicity of lines 9 extending vertically and individually spaced apart from one another at a specific grid width, the vertically disposed lines 9 extending over the distinct contrast transition from a light background to relatively darkly illustrated copy areas. The contrast leap that occurs for each vertical line 9 is represented by a respective interruption in the vertical line 9, in the form of a marking 10. If the number of markings 10 are added up along the course of the folding spine 8, the course of the folding edge or of the cutting edge then results.

Figure 3:
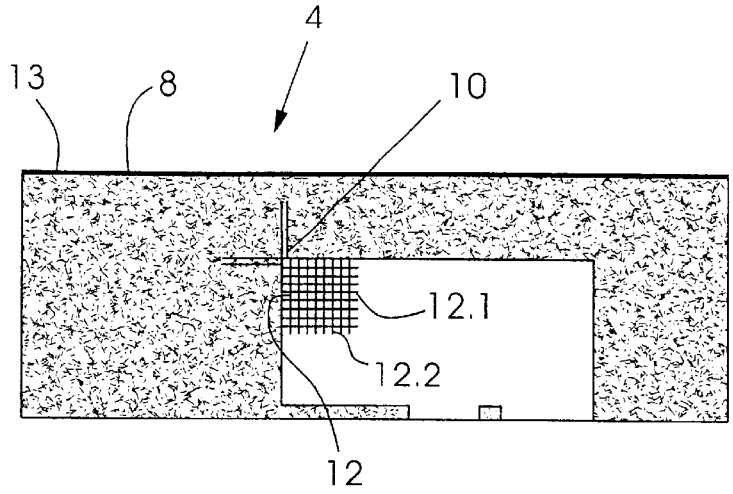
FIG. 3 is a diagrammatic view of a screen field or patch superimposed on a printed image and having a vertical and horizontal grid pattern.

FIG. 3 shows a screen field or patch superimposed on the printed image and having a line structure that extends vertically and horizontally.

Applied in the region of the printed image 5 is a square screen field 12 having a grid structure of vertically and horizontally extending lines. In FIG. 3, one quadrant of the screen field 12 is illustrated as covering a capital letter in the printed image 5. In order to illustrate the contrast leap established between the dark outer area surrounding the depicted quadrant, and the light area, the markings 10 have been combined into a perpendicularly extending series of lines. The intersection between the two mutually perpendicular series of lines constitutes a fixed point which is suitable for determining the distance 6 between the folding or cutting edge 8 and the edge region of the printed image 5. The square screen field or patch 12 according to FIG. 3 has a prescribed grid-line spacing between the series of lines 12.1 and 12.2, which is set or matched to the required resolution. The resolution by the method according to the invention is of the order of 0.1 mm, which can be viewed as completely adequate for the detection of the positional accuracy.

The grid spacing can also be varied in accordance with the respective printed subject 5, which has barely any influence upon the detection sensitivity. If a greater grid spacing is selected, whether in the vertical screen field 7 or in the screen field 12 of square configuration, the position of the folding edge and the cutting edge, respectively, and of the printed image 5 can be determined more quickly. This would be of interest, for example, at very high production speeds.

Figure 4:
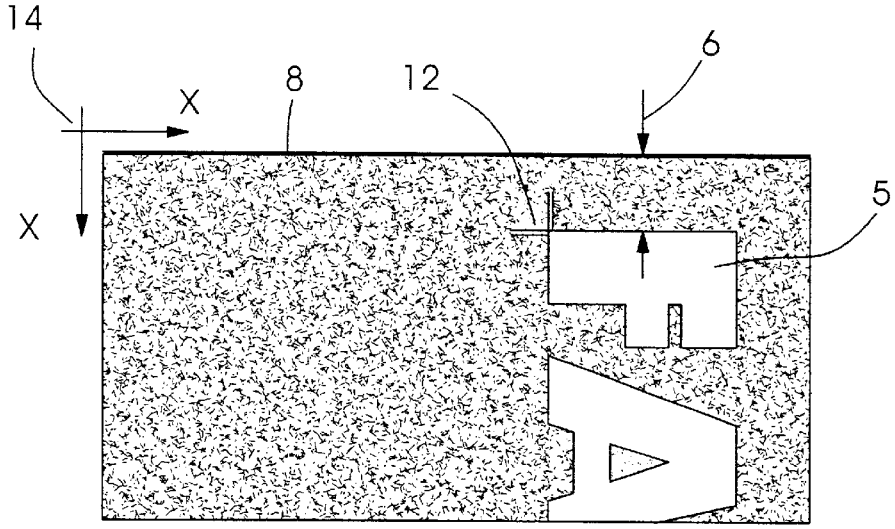
FIGS. 4 and 5 are similar views of folded copies with folded edges and printed regions, which are of interest.
Figure 5:
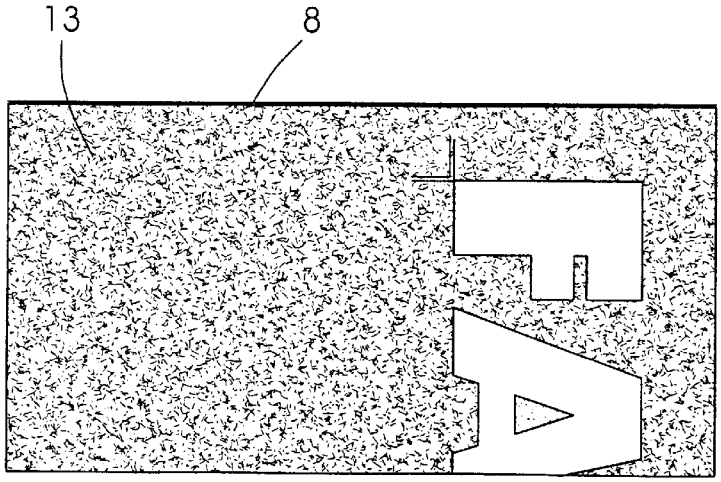

FIGS. 4 and 5 illustrate flat folded copies 13 wherein the folding spine 8 represents a reference edge, from which the printed image 5 is located a distance 6. The coordinate system 14 serves as a reference system, by the use of which an accuracy determination of the position of the folded copy 13 is performed. The X-axis of the coordinate system 14 is used for the coarse alignment of the folding spine 8 of the folded copy 13. Using the distance 6 on the folded copy 13, the position of the folding spine 8 in relation to the printed image 5 can be determined. If the position of the angularly extending marking line 10 is known from the square grid 12, the end of the printed image 5 can then be determined by using the detected contrast leap. The distance 6 extends thereafter from the point of intersection of the marking lines 10 in the angularly extending square grid 12, to the corresponding marking line 10 of the vertical grid 7.

Figure 6:
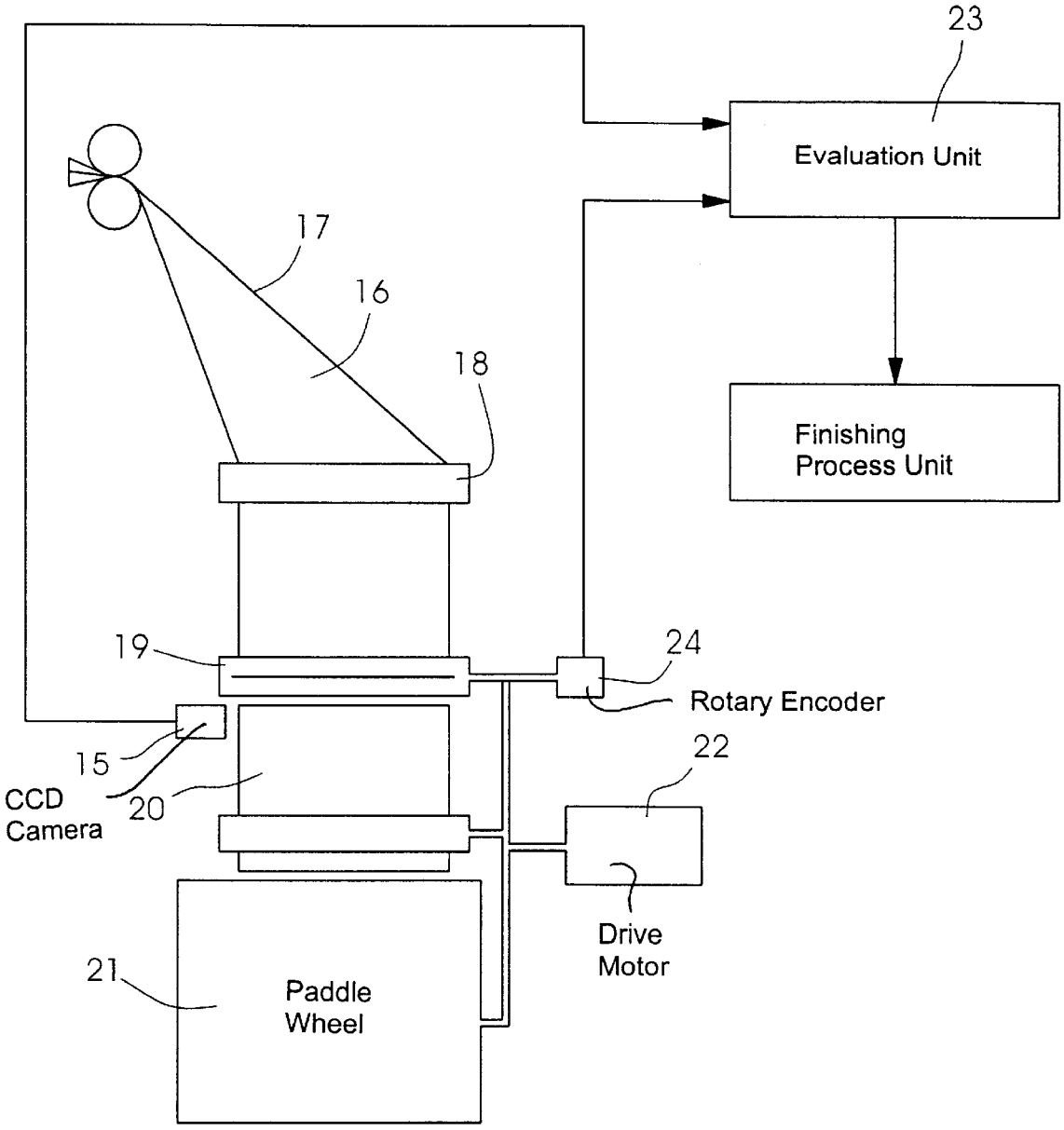
FIG. 6 is a diagrammatic and schematic view of a folder having a CCD camera for scanning the surface of a separated folded copy.

FIG. 6 shows diagrammatically and schematically an arrangement wherein a copy 20 separated from a material web 16 is scanned by a CCD camera 15, which functions as a detector. In the embodiment of the invention shown in FIG. 6, the CCD camera 15 is the component which generates the recording field, and transmits the registered data to an evaluation unit 23.

The material web 16 running onto a folder former, passes over an infeed-roller pair 18 into a cylinder part of the folder. In this case, it is unimportant whether the folder is constructed with sets of pins or is a folder which operates without pins and transports the copies by transport or conveyor belts. The individual copies 20 are separated from the material web 16 by a cutting-cylinder pair 19. Arranged underneath the cutting-cylinder pair 19 is the CCD camera 15, which locates the preselectable folding-edge or cutting-edge regions, and the position of the printed image 5, which is to be detected, by the individually predefinable or prescribable search regions 2 and 4.

Through the intermediary of a rotary encoder 24 that is assigned to the cutting-cylinder pair 19, the cutting register can be coordinated with or adjusted to the position of the printed image 5 scanned by the CCD camera 15.

In the exemplary embodiment illustrated in FIG. 6, the cutting-cylinder pair 19 and the paddle or fan wheels 21 are driven by a common drive motor 22. It is also readily possible to drive the cylinders provided in folders, with individual drives as well, the phase angle thereof relative to one another being synchronized electronically.

I claim:

1. A method of detecting the positional accuracy of register and any of folding and cutting-edge positions, respectively, on flat copies, including scanning a recording field on the copy by a detector, the recording field on the copy, respectively, being prescribable, which comprises determining the position of the printed image and of the folding and cutting edges, respectively, by contrast transitions extending through screen fields.

2. The method according to claim 1, which includes prescribing scanning zones in the recording field by a user of the method.

3. The method according to claim 1, which includes superimposing screens on defined scanning zones in the recording field.

4. The method according to claim 1, which includes providing sets of vertical lines for covering at least one of the folding and the cutting edges, respectively, in the screen fields.

5. The method according to claim 1, which comprises providing the screen fields with horizontal lines and vertical lines sweeping over edge regions.

6. The method according to claim 4, which includes placing markings at the vertical lines interrupted at a transition between background and copy.

7. The method according to claim 6, which includes determining the course of a folding spine from the position of the markings.

8. The method according to claim 6, which includes determining the course of the cutting edges from the position of the markings.

9. The method according to claim 5, which includes determining the position of the printed image from the markings of the screen field, which distinguish contrast leaps.

10. The method according to claim 1, which includes determining the distance between the printed image and a respective folding and cutting edge from the course of the sequence of markings of the screen field, respectively, representing one of a folding spine and the cutting edges, respectively, and the markings of the screen field representing the edge of the printed image.

* * * * *